US007140585B2

(12) United States Patent
Wakuta

(10) Patent No.: US 7,140,585 B2
(45) Date of Patent: Nov. 28, 2006

(54) ONE-HAND CLIP CAPABLE OF PREVENTING HANGING OBJECT FROM DROPPING

(76) Inventor: Shohachi Wakuta, Itopia Higashioshima MS812, 39-22, Oshima 8-chome, Koto-ku, Tokyo (JP)

( * ) Notice: Subject to any disclaimer, the term of this patent is extended or adjusted under 35 U.S.C. 154(b) by 0 days.

(21) Appl. No.: 10/902,518

(22) Filed: Jul. 29, 2004

(65) Prior Publication Data

US 2005/0029421 A1 Feb. 10, 2005

(30) Foreign Application Priority Data

Aug. 8, 2003 (JP) ..... 2003-317513

(51) Int. Cl.
*F16B 45/00* (2006.01)

(52) U.S. Cl. ..... 248/306; 248/305; 248/316.5; 248/74.2; 24/648; 24/495; 223/90; 223/91; 223/93

(58) Field of Classification Search ..... 248/306, 248/304, 305, 316.3, 74.1, 58, 65, 316.5, 248/74.2; 24/648, 495, 589.5, 599.7, 599.4; 223/90, 91, 93, 96

See application file for complete search history.

(56) References Cited

U.S. PATENT DOCUMENTS

| | | | | |
|---|---|---|---|---|
| 67,489 | A * | 8/1867 | Bottomley | 54/56 |
| 243,898 | A * | 7/1881 | Hill, Jr. | 248/113 |
| 364,978 | A * | 6/1887 | Vintree et al. | 248/316.3 |
| 369,318 | A * | 9/1887 | Craine | 248/113 |
| 451,182 | A * | 4/1891 | Gaillac | 248/316.3 |
| 749,760 | A * | 1/1904 | Townsend | 188/67 |
| 1,404,436 | A * | 1/1922 | Giroux | 452/187 |
| 1,520,716 | A * | 12/1924 | Judd | 24/134 P |
| 1,609,666 | A * | 12/1926 | Settevig | 248/113 |
| 2,476,734 | A * | 7/1949 | Jellison | 294/82.32 |
| 3,727,812 | A * | 4/1973 | Weiss | 223/111 |
| 4,436,266 | A * | 3/1984 | Gerding | 248/74.1 |
| 4,877,228 | A * | 10/1989 | Ripert | 269/156 |
| 6,953,175 | B1 * | 10/2005 | Carrera | 248/74.1 |

FOREIGN PATENT DOCUMENTS

| | | |
|---|---|---|
| JP | 09-118090 | 5/1997 |
| JP | 2000-247080 | 9/2000 |

* cited by examiner

*Primary Examiner*—Kimberly T. Wood
(74) *Attorney, Agent, or Firm*—Flynn, Thiel, Boutell & Tanis, P.C.

(57) ABSTRACT

A one-hand clip of the present invention is composed of a main body, a pair of semicircular hooks a pair of rotating pins and a pair of elastic bodies. The hooks each fixed by a rotating pin and an elastic body at each bottom end of the main body pinches an inserted object by the power created by the spring of the elastic bodies as well as by the weight of the inserted object to be hung. Inserting or detaching operation is accomplished by an upward movement of the inserted object thus requiring little power or skill of the user.

11 Claims, 2 Drawing Sheets

ONE-HAND CLIP CAPABLE OF PREVENTING HANGING OBJECT FROM DROPPING

BACKGROUND OF THE INVENTION

1. Field of the Invention

The present invention relates to a clip mainly used for pinching and fastening hanging objects such as laundry or the like and provides a clip capable of hanging and releasing the objects by simple one-handed operation which requires minimum power or skill of a user.

2. Related Background Art

Conventionally, clothespins or other similar implements are commonly used for hanging the laundry or the like. These conventional clothespins and other implements require both hands of a user to hang or release the laundry or other objects. Fingers of a user strong enough to operate these conventional implements are also required. For the benefit of the handicapped and the elderly citizens, there exist needs to develop a clip easy to handle, requiring less power or skill for hanging and releasing operation, and pinching the hanging objects tightly.

SUMMARY OF THE INVENTION

The present invention relates to a clip for hanging laundry or the like. The purpose of the invention is to provide a clip easily handles by one hand and capable of hanging and releasing the laundry or other objects using minimum power and skill and to eventually contribute to social welfare.

A clip of the present invention consists of a main body, a pair of semicircular hooks a pair of rotating pins and a pair of auxiliary springs. Each semicircular hook is fixed by a rotating pin and an auxiliary spring at each bottom end of the main body so that the tip ends of both hooks can meet.

Insertion of laundry or other object into the clip is accomplished by their upward movement from under the clip followed by the actions of the springs which raise and separate the tip ends of both hooks to form an opening. After a user unhands the object, the inserted object is held between the tip ends by the actions of the springs which then lower both tip ends and narrow the opening. The weight of the inserted object also lowers the tip ends of the hooks and thus adds the narrowing power. The inserted object is pinched and fastened accordingly.

To detach the inserted object from the clip, another upward movement of the object followed by the actions of the springs raises and separates the tip ends of both hooks and releases the pinching power.

The shape of a hook is not limited to semicircular but various shapes are applicable such as elliptic, streamlined or the like. Further, the spring is not limited to a spiral steel spring but other elastic materials such as rubber or the like are applicable.

DETAILED DESCRIPTION OF THE PREFERRED EMBODIMENTS

Embodiment 1

FIG. 1 shows an embodiment of the present invention. The main body 1 is made of water resistant resin or the like on which a rotating C-shaped hook 5 is mounted. Using this C-shaped hook 5, a clip is fixed to a clothesline, a rod, a frame or the like on which laundry or the like are hung out to dry. A pair of semicircular hooks 2 each fixed at each bottom end of the main body 1 by a rotating pin 3 and an auxiliary spring 4 have each a tip end which touches each other when nothing is inserted and separates by the action of the spring 4 to form an opening to let an inserted object moveupward.

A user holding the laundry or other object on or between his fingers raises his hand to insert the object into a clip. When he unhands the inserted object, both tip ends of the hooks 2 lowered by the actions of the springs 4 as well as by the weight of the inserted object itself pinch and fasten the inserted object.

The user lifts the inserted object again to let the tip ends of the hooks 2 separate and release the pinching power. The upward movement of the tip ends of the hooks 2 for separating requires only a little power as that the user easily manages inserting and detaching operations.

Embodiment 2

FIG. 3 shows another embodiment of the present invention. Like Embodiment 1, the main body 1 is made of water resistant resin or the like on which a rotating C-shaped hook 5 is mounted. Using this C-shaped hook 5, a clip is fixed to a clothesline, a rod, a frame or the like on which laundry or the like are hung out to dry. Inserting and detaching operations are similar to those of Embodiment 1. For the purpose of hanging a wide piece of cloth or drapery, a pair of wide hooks are attached.

Figure 1:
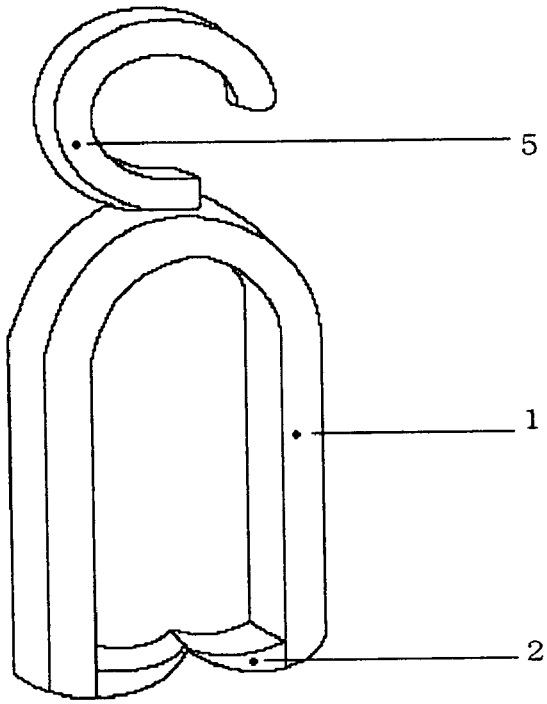
FIG. 1 is a perspective view of a clip of the present invention.
Figure 2:
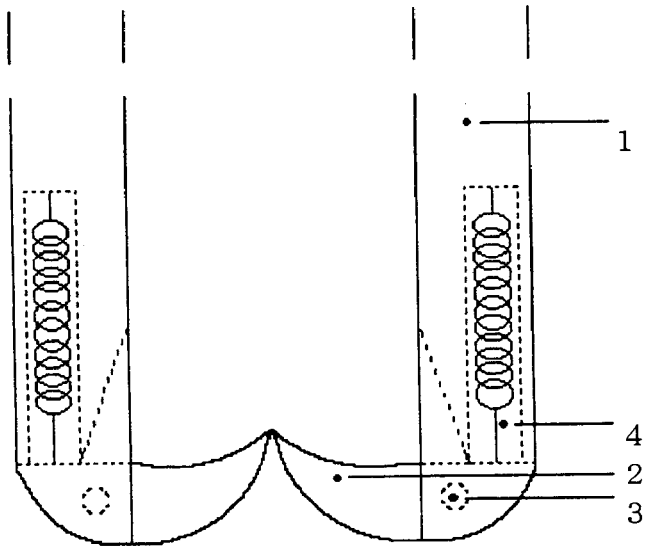
FIG. 2 is a cross sectional view of a lower part thereof.
Figure 3:
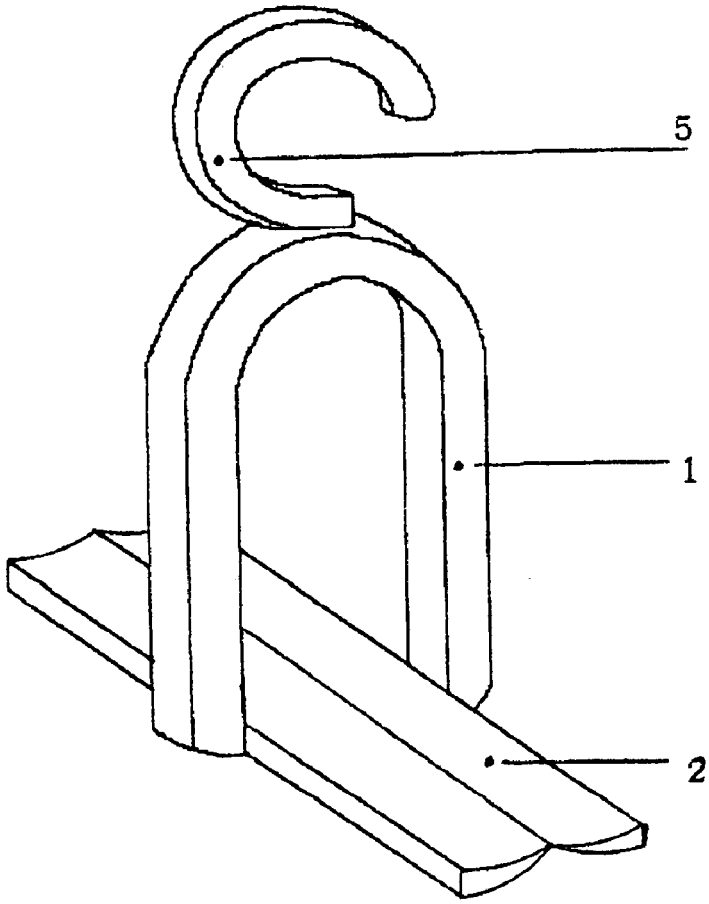
FIG. 3 is a perspective view of a clip of another embodiment.

What is claimed is:

1. A one-hand clip comprising a main body and a pair of hooks each fixed to a respective bottom end of said main body by a rotating pin wherein said hooks project inwardly toward each other and have tip ends which are movable toward and away from each other during rotation of said hooks, said main body including an elastic body at each bottom end of said main body wherein said bottom ends of said main body have interior pockets which respectively receive said elastic bodies and said elastic bodies are completely contained within the interior pockets, each said elastic body being connected to a respective one of said hooks wherein said elastic bodies resiliently bias said hooks to bias said tip ends inwardly toward each other into contact with each other and resiliently resist movement of said tip ends away from each, said tip ends terminating at sidewardly elongate sharp edges to define line contact between said tip ends when disposed in contact wherein an object to be hung is inserted between the tip ends of said hooks, pinched by a pinching force generated by each said elastic body and by the weight of said object acting downwardly on said tip ends, and said pinching force prevents said object from dropping.

2. A one-hand clip according to claim 1, wherein said hooks are wide and said main body is narrow such that said hooks project sidewardly beyond opposite sides of said main body.

3. A one-hand clip according to claim 1, wherein said pockets are blind bores which open downwardly and said elastic bodies are coil springs which extend downwardly from respective bottom ends of said bores into engagement with outer ends of said hooks.

4. A one-hand clip according to claim 3, wherein said outer end and said tip end of each said hook are disposed on opposite sides of said rotating pin and said spring is disposed in tension.

5. A one-hand clip according to claim 1, wherein said tip ends project inwardly and upwardly so as to press inwardly against each other and said hooks include respective outer ends enclosed within said main body so that said outer ends do not project outwardly of said main body.

6. A one-hand hanger clip for hanging an object comprising:

a main body adapted to hang from a support element, and a pair of hooks rotatably fixed to respective bottom end portions of said main body by pivot pins;

said hooks projecting inwardly toward each other and having terminal tip ends which are movable toward and away from each other during rotation of said hooks;

said bottom end portions of said main body each having an elastic biasing body which is connected between said bottom end portion and said respective hook to resiliently bias said hooks together to thereby bias said tip ends inwardly together into contact with each other while resiliently resisting movement of said tip ends outwardly away from each other, said bottom end portions including a hollow interior comprising respective blind pockets having a closed end and an open end which receives the respective one of said elastic bodies therein so that said elastic bodies are completely contained within the hollow interior of said main body, said elastic bodies having bottom ends which project toward respective outer ends of said hooks and are connected to said outer ends within the interior of said main body to prevent external access to said elastic bodies;

wherein said tip ends are configured such that said object to be hung is inserted between said tip ends and is pinched by a pinching force generated by said elastic bodies and by the weight of said object acting downwardly on said tip ends which said pinching force prevents said object from dropping and said biasing of said tip ends permits said object to be pushed upwardly to release said pinching by said tip ends.

7. A hanger clip according to claim 6, wherein said main body includes a hanger on an upper end portion to permit hanging of said hanger clip from a support element by one hand.

8. A hanger clip according to claim 7, wherein said pockets are blind bores which open downwardly and said elastic bodies are coil springs which extend downwardly from the respective open ends of said bores into engagement with said outer ends of said hooks.

9. A hanger clip according to claim 8, wherein said tip ends project inwardly and upwardly so as to press inwardly against each other and said outer ends are completely contained within the interior of said main body.

10. A hanger clip according to claim 6, wherein said tip ends terminate at sidewardly elongate sharp edges to define line contact between said tip ends when disposed in contact with each other.

11. A one-hand hanger clip for hanging an object comprising:

a main body having an upper end portion with a hanger that is adapted to hang from a support element by placement with one hand, said main body further including a pair of hooks rotatably fixed to respective bottom end portions of said main body by pivot pins;

said hooks projecting inwardly and upwardly toward each other and having terminal tip ends which are movable toward and away from each other during rotation of said hooks, said tip ends terminating at sidewardly elongate sharp edges which define line contact between said tip ends when disposed in contact with each other, said hooks further including outer ends completely contained within an interior portion of said main body; and said bottom end portions of said main body each having an elastic biasing body which is connected between said bottom end portion and said respective hook to resiliently bias said hooks together to thereby bias said tip ends inwardly together into said line contact with each other while resiliently resisting movement of said tip ends away from each other, said bottom end portions including respective blind pockets each having an upper pocket end and an open lower pocket end which opens toward said outer end of said hook, said lower pocket end receiving the respective one of said elastic bodies therein so that said elastic bodies are completely contained within the interior portion of said main body, said elastic bodies having bottom ends which project toward said respective outer ends of said hooks through said lower pocket ends and are connected to said outer ends within the interior portion of said main body to prevent external access to said elastic bodies, each said pin being disposed between said outer end and said tip end of said respective hook with said respective elastic body being disposed in tension;

wherein said tip ends are configured such that said object to be hung is inserted between said sharp edges of said tip ends and is pinched therebetween by a pinching force generated by said elastic bodies and by the weight of said object acting downwardly on said tip ends which said pinching force prevents said object from dropping while said biasing of said tip ends permits said object to be pushed upwardly by one hand to separate said tip ends and release said pinching by said tip ends.

* * * * *